United States Patent [19]

Lane

[11] 4,194,349

[45] Mar. 25, 1980

[54] APPARATUS AND METHOD FOR GATHERING AND DISPLAYING INFORMATION

[75] Inventor: John E. Lane, Littleton, Mass.

[73] Assignee: Parks-Cramer Company, Fitchburg, Mass.

[21] Appl. No.: 900,267

[22] Filed: Apr. 26, 1978

[51] Int. Cl.[2] ..... D01H 13/32

[52] U.S. Cl. ..... 57/265; 57/81; 57/276; 340/721

[58] Field of Search ..... 57/34 R, 75, 80, 81, 57/156, 1 R, 264, 265, 276–278; 340/720, 721

[56] References Cited

U.S. PATENT DOCUMENTS

| | | | |
|---|---|---|---|
| 3,523,413 | 8/1970 | Ford et al. | 57/34 R |
| 3,638,412 | 2/1972 | Rebsamen | 57/34 R X |
| 3,659,409 | 5/1972 | Saunders | 57/34 R |
| 3,680,298 | 8/1972 | Saunders | 57/34 R |
| 3,680,299 | 8/1972 | Lee, Jr. | 57/34 R |
| 3,877,209 | 4/1975 | Seidl et al. | 57/34 R |
| 3,877,210 | 4/1975 | Seidl | 57/34 R |
| 3,878,671 | 4/1975 | Seidl et al. | 57/34 R |
| 4,019,310 | 4/1977 | Seidl et al. | 57/34 R |

*Primary Examiner*—John Petrakes

*Attorney, Agent, or Firm*—Bell, Seltzer, Park & Gibson

[57] ABSTRACT

Apparatus and method for displaying information regarding the operating conditions of ring spinning machines in a textile mill wherein at least one traveling unit, supported for travel along a predetermined path for traversing one or more ring spinning machines, carries detectors for monitoring ends of strand material normally being formed by traversed machines and a data system responds to the detectors for determining the condition of the traversed machines from the condition of the monitored ends. In accordance with this invention, additional sensors are provided on each machine for signalling operating characteristics of the machines. A processor operatively communicating with the sensors and responsive to signals from the sensors determines from such signals the operating conditions of respective ones of the machines and generates a display signal indicative of the determined conditions, and a visual display operatively communicating with the processor and responsive to the display signals presents a visual display of the determined condition of the machines. In particular, the visual display includes indicia for various time, speed, doffing readiness, and time in doff conditions.

60 Claims, 9 Drawing Figures

CRT
11
12
12
10
10

APPARATUS AND METHOD FOR GATHERING AND DISPLAYING INFORMATION

The invention to be described hereinafter is related to certain prior inventions owned in common with the present subject invention and disclosed in prior U.S. Pat. Nos. 3,523,413; 3,726,072; and 4,000,603 to which the attention of the interested reader is directed. To any extent necessary or appropriate to an understanding of the present invention, the disclosures of those prior United States patents are hereby incorporated by reference into the following description.

As is pointed out in the aforementioned related prior patents, effort has been expended heretofore toward optimising the machines and methods involved in forming textile yarn. Particularly with regard to ring spinning machines, as evidenced by the aforementioned patents, such development has included apparatus and methods for detecting broken yarns on spinning machines, interrupting the supply of roving strand materials to the drafting systems by which attenuated strand materials are formed as a portion of the process of spinning yarn, and providing information to machine operators and mill management concerning operating conditions of the machines.

As the apparatus and methods proposed in accordance with the aforementioned prior patents have achieved acceptance and some success in textile mills, and as operators and management have learned to use reported information to increasing advantage, the desirability of including yet further information for the assistance of operators and managers has become apparent.

More particularly, it has been recognized that the division of operator functions between those traditionally assigned to an operator known as a "Spinner" and those traditionally assigned to an operator known as a "Doffer" provides an opportunity for yet further improved efficiency in management and operations by monitoring of operating conditions related to doffing as well as those related to spinning. As is known to persons skilled in the textile arts, a spinner is assigned the task of repairing broken strands or "putting up ends" and may be assigned the additional task of creeling bobbins of roving. A doffer is assigned the task of removing from the spindles of a ring spinning machine completed packages of yarn, by lifting bobbins from the spindles and replacing the filled bobbins which have been removed with empty bobbins about which yarn is to be wound. The aforementioned related patents have addressed themselves primarily to improved efficiency for spinners and for operating conditions related to ends down.

With the foregoing in mind, it is an important object of this invention to facilitate more efficient use of all operators working with ring spinning machines in a textile mill. In realizing this object of the present invention, information concerning operating conditions of the machines in addition to ends down information is accumulated and used in visual displays which make available to operators information concerning the operation of the machines in the textile mill.

A further object of the present invention is to accomplish the displaying of information regarding the operating conditions of ring spinning machines in a textile mill in a manner which provides management with a numerical, visual display of data which has been collected. In realizing this object of the present invention, various operating characteristics of each machine are sensed, such as revolutions of the delivery rolls from which strand material issues, the position of guides through which the strand material moves, and the position of rails carrying the rings through which the strand material moves during winding. Signalling occurs in response to sensed movements of such machine components.

Yet a further object of the present invention is to provide apparatus capable of selectively displaying, by means of "television," information regarding doffing times and conditions of a plurality of spinning machines in a textile mill, and speeds of delivery rolls through which strand material issues. In realizing this object of the present invention, cathode ray tube video devices having an appearance somewhat similar to conventional television receivers are driven by a suitable display signal so as to present to mill operators and management a visual display coordinated with the position of ring spinning machines in a mill.

Some of the objects and advantages of the invention having been stated, others will appear as the description proceeds, when taken in connection with the accompanying drawings, in which—

While the present invention will be described hereinafter with particular reference to the accompanying drawings, it is to be understood at the outset of the following description that persons skilled in the arts applicable to the present invention will be enabled by this disclosure to construct apparatus and practice methods which embody the present invention and yet take forms which may differ from those here particularly described and shown. Accordingly, the description which follows is to be understood broadly as an enabling disclosure directed to persons skilled in the appropriate arts, and is not to be taken as being restrictive upon the scope of the present invention.

Referring now more particularly to the drawings, the present invention is contemplated as being particularly useful in connection with a plurality of ring spinning machines, certain of which are indicated generally at 10 (FIG. 1), arranged in a plurality of rows in a textile mill.

Figure 1:
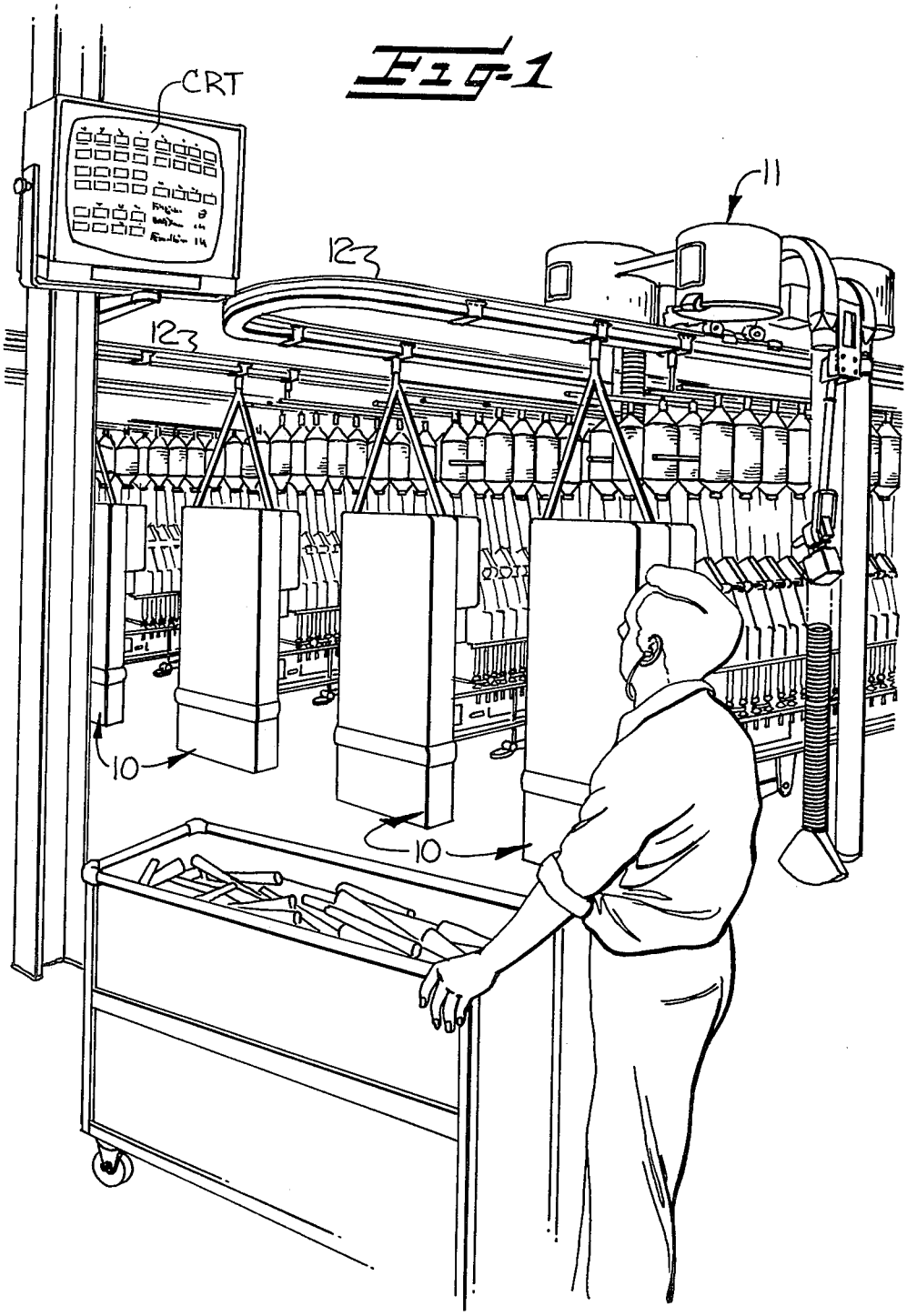
FIG. 1 is a perspective view of a textile mill incorporating an installation of an apparatus in accordance with the present invention.
Figure 2:
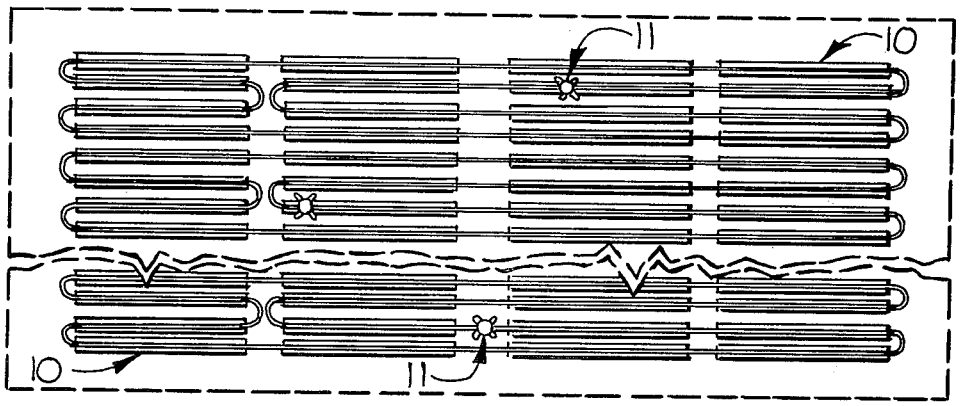
FIG. 2 is a partly schematic plan view of a textile mill similar to that of FIG. 1, illustrating a plurality of spinning machines.

One typical arrangement is schematically illustrated in FIG. 2, where spinning frames are arranged in rows of four. One or more traveling units, one of which is generally indicated at 11 in FIG. 1, are supported for traversing the textile machines 10 along predetermined paths of travel. In the drawings, and consistent with the disclosures of the aforementioned related prior patents, the traveling units 11 are substantially identical to the fourth embodiment disclosed in U.S. Pat. No. 3,304,571 owned in common with the present invention. As disclosed in that patent, each of the traveling units 11 is supported for movement along a track 12 extending above the spinning machines 10. Conventionally, such a track describes a closed pattern of so-called H-loop configuration (FIG. 2). Each traveling unit includes drive means for driving it in movement along the track so as to traverse the machines in a circuit automatically and at predetermined intervals.

The ring spinning machines 10 include elements or operating instrumentalities for receiving strand material in a form known as roving, drawing or attenuating the strand material, and twisting or spinning the attenuated strand material to form yarn. The operating instrumentalities of a ring spinning machine are well known to persons skilled in the applicable textile arts but will be noted to include front or delivery rolls 14 from which strand material issues, "pig tails" or intermediate guides 15 through which strand material passes, and rings 16 encircling spindles 18 and about which travelers 19 move in twisting or spinning ends E of yarn. The rings 16 are mounted in ring rails 20 which move vertically relative to the spindles 18 and thereby position strand material relative to packages formed about bobbins received on the spindles 18 during winding.

In order to monitor the condition of ends of strand material normally being formed by a traversed machine 10, detectors are mounted on the traveling unit 11 in accordance with the teachings of the aforementioned related U.S. Pat. Nos. 3,523,413; 3,726,072; and 4,000,603. A data system is provided which is responsive to the detectors for determining the ends down condition of the traversed machine from the conditions of the monitored ends and may include apparatus constructed and operating to control actuation of roving feed stop devices such as are disclosed in the aforementioned patents and generally indicated at 21 and to communicate substantially continuously in accordance with the teaching of U.S. Pat. No. 3,680,298 owned in common with the present invention and hereby incorporated by reference into the present description to any extent necessary or appropriate to a complete understanding of the present invention.

In accordance with the present invention, apparatus and methods as discussed generally to this point are improved by providing sensor means mounted on each of the ring spinning machines 10 for signalling certain operating characteristics of the machines. Processor means operatively communicate with the sensor means and respond to signals therefrom for determining from the signals the operating condition of respective ones of the machines. The processor means generate display signals indicative of the determined conditions. The display signals are communicated to a visual display means, which responds by presenting a visual display of the determined conditions of the machines. Specific preferred forms for such apparatus, and methods by which visual displays are presented, will be more particularly pointed out in the discussion which follows.

Figure 3:
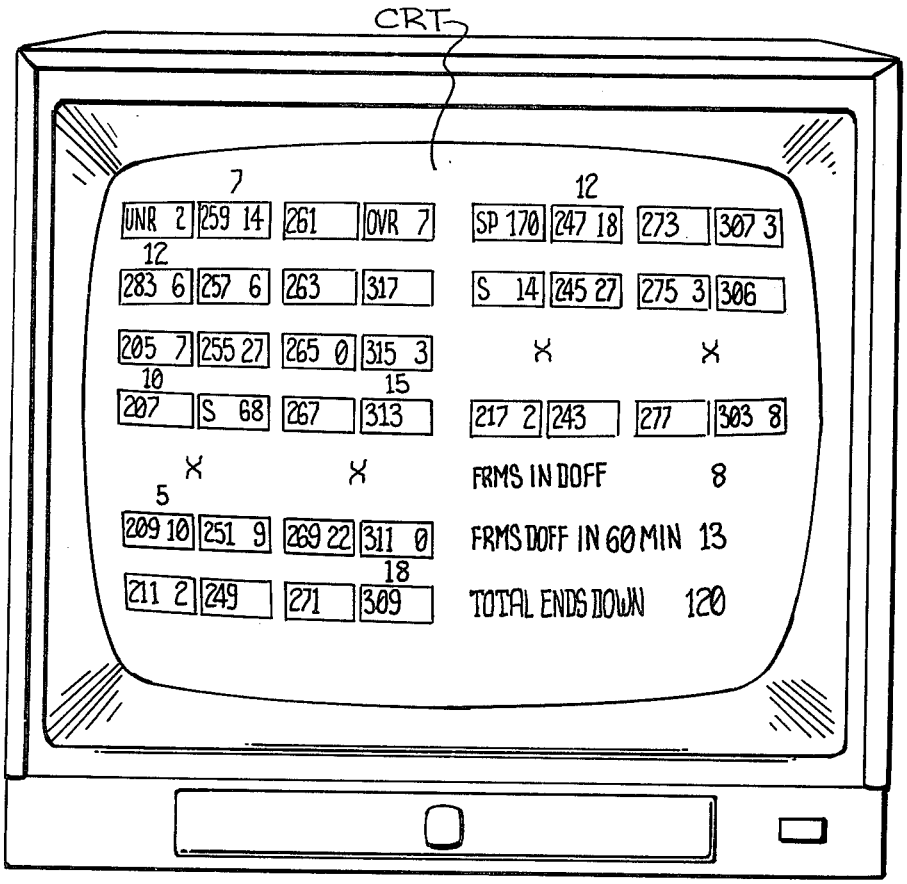
FIG. 3 is an elevation view of a visual display in accordance with the present invention.
Figure 6:
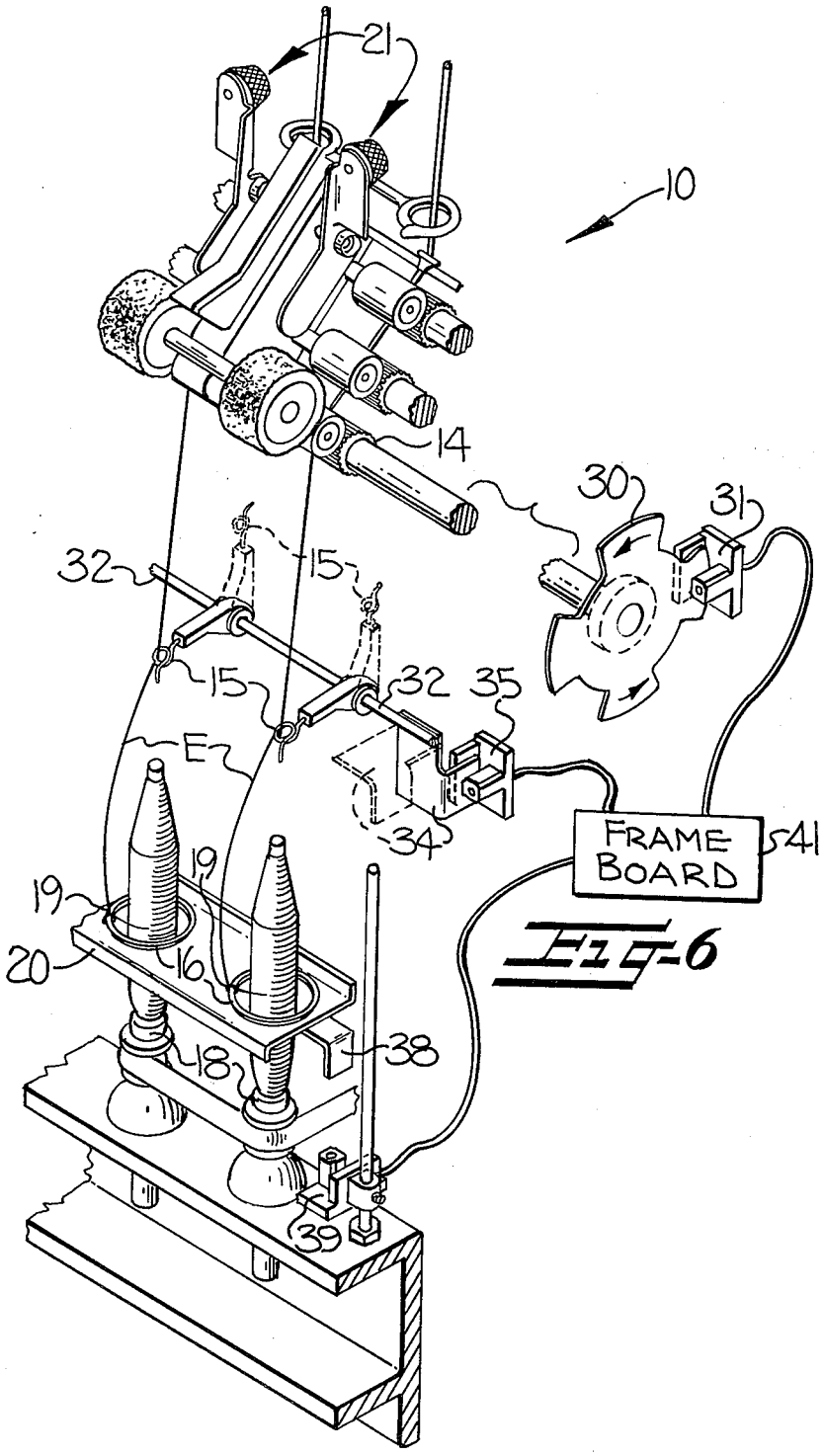
FIG. 6 is a partially schematic perspective view of certain components of the spinning machine of FIG. 5, taken from the point of view indicated by the arrow 6 in that figure.
Figure 7:
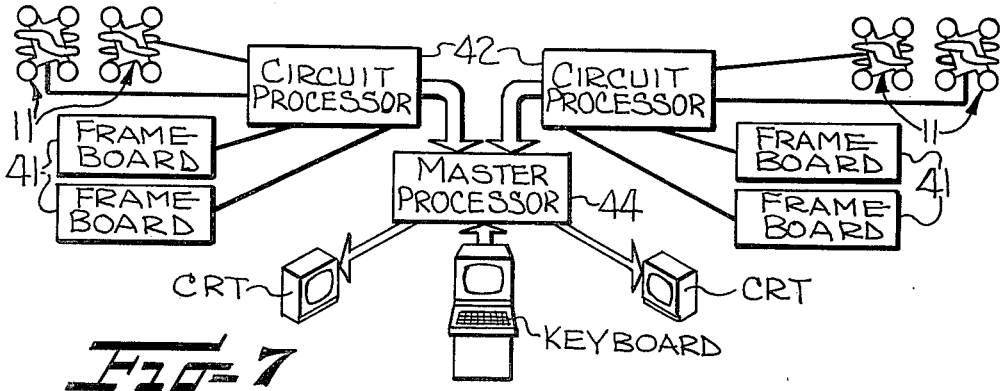
FIG. 7 is a schematic representation of the operative communication among certain components of apparatus in accordance with the present invention.

Preferably, and as illustrated in FIGS. 1 and 3, the visual display means takes the form of a cathode ray tube (hereinafter sometimes called a CRT) video device, similar to the well known television receiver set. The sensor means preferably comprises a plurality of sensors (FIG. 6) sensing a plurality of the operating characteristics of a machine. The processor means preferably takes the form of a plurality of frame boards corresponding in number to the number of ring spinning machines 10, a plurality of circuit processors which number a fraction of the number of the frame boards, and a single main processor (FIG. 7).

Figure 4:
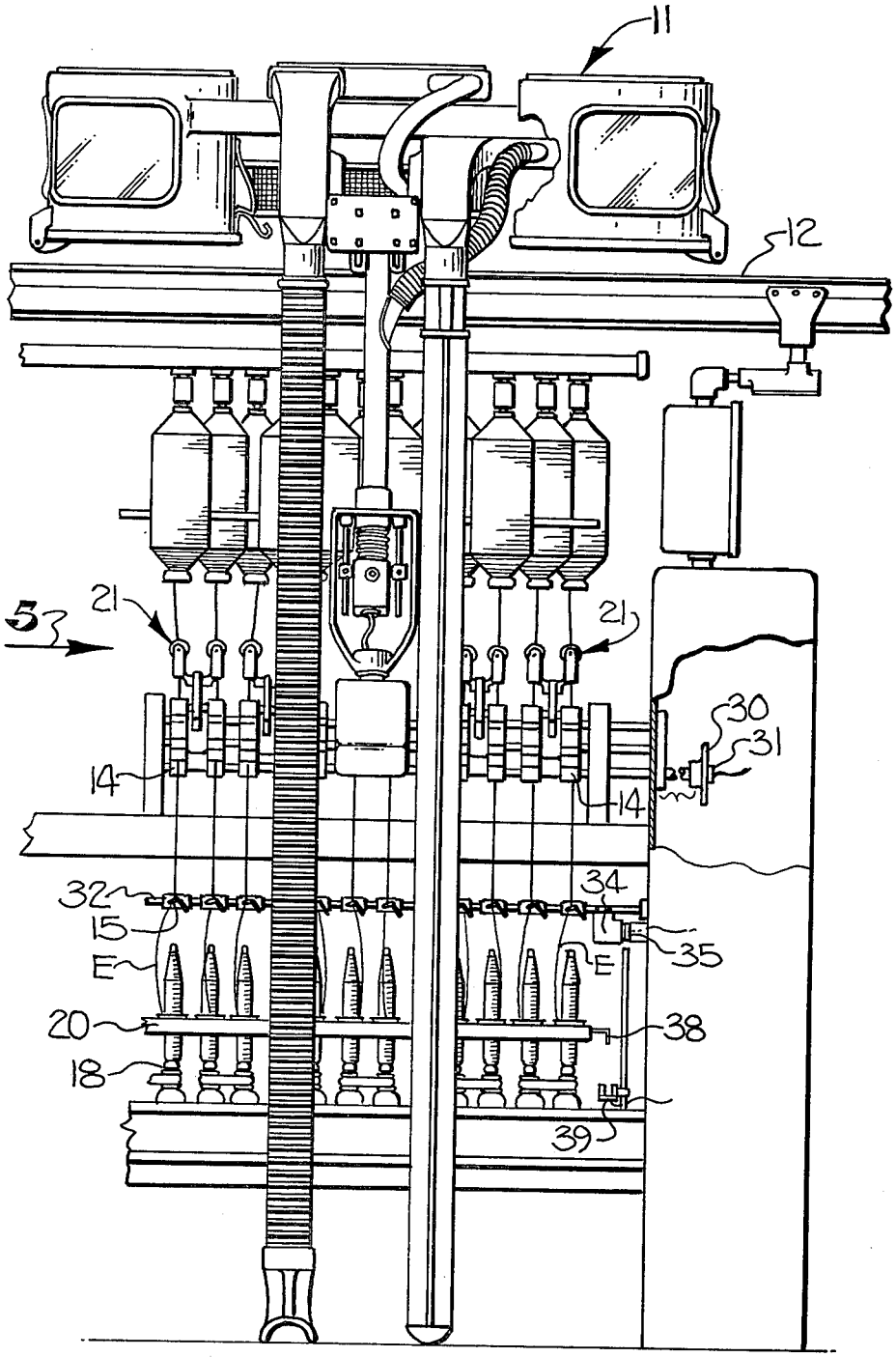
FIG. 4 is a side elevation view, partly broken away, of a ring spinning machine as shown in FIG. 1.
Figure 5:
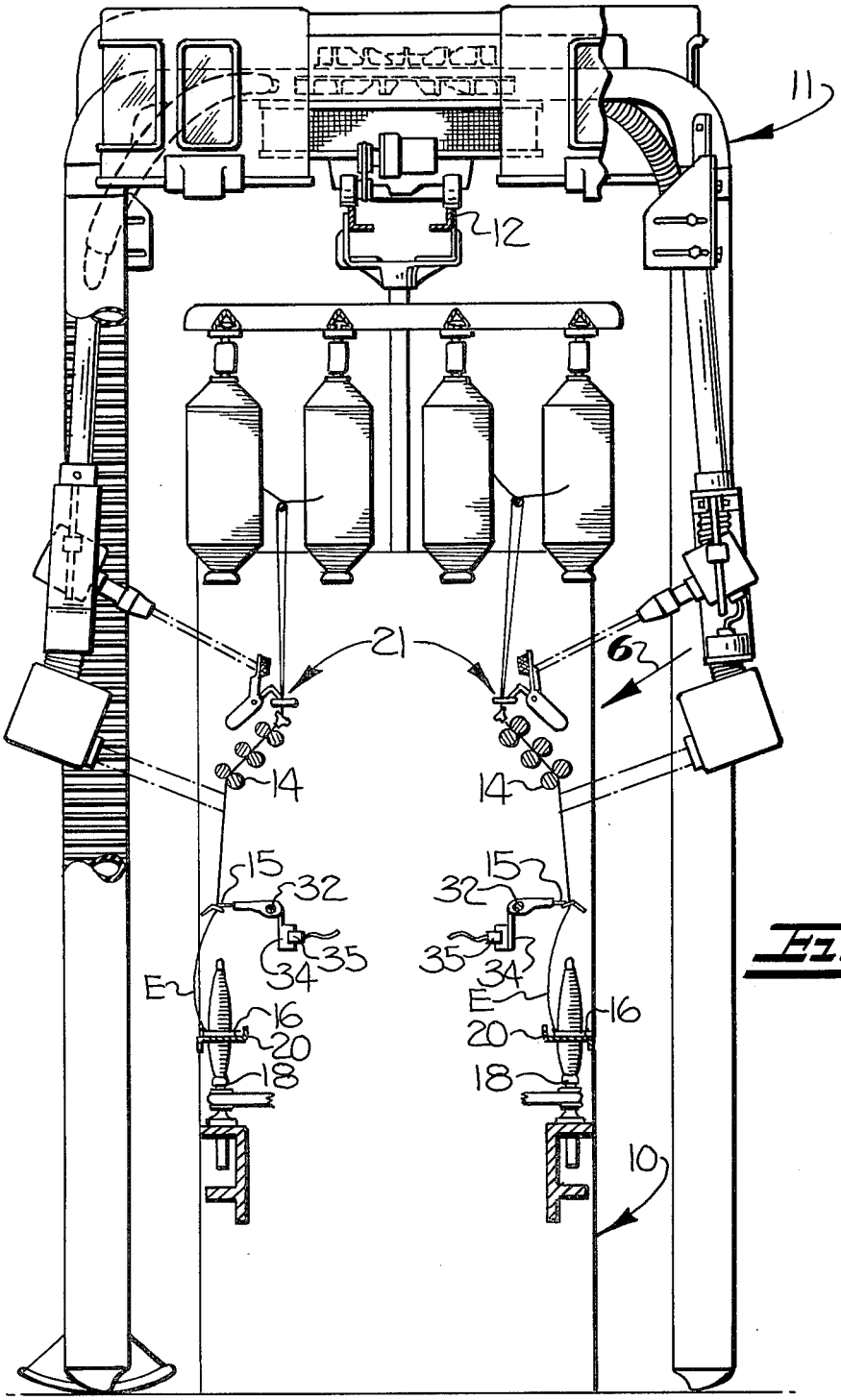
FIG. 5 is an end elevation view, partially in section, of the spinning machine of FIG. 4, taken generally as indicated by the arrow 5 in FIG. 4.

Referring now more particularly to the sensor means mounted on each machine, one sensor means takes the form of a suitable electrical device and associated components together functioning as a rotation sensor means for generating a train of electrical pulse signals at a frequency proportional to revolutions of the delivery rolls 14 from which strand material issues. In the form shown, a rotor 30 (FIGS. 4 and 6) of a magnetic material such as steel is operatively interconnected with the delivery roll 14 to rotate therewith. The interconnection may be direct or indirect through gearing by which the rolls are driven. The rotor 30 has a plurality of radially extending vanes which pass adjacent a Hall effect device 31 responsive to variations in the magnetic field about the rotor 30 for generating a train of electrical pulse signals. Persons skilled in the electrical and the electronic arts will recognize that other forms of sensor means may be employed, such as other magnetic sensor devices, photoelectric sensor devices, or mechanically actuated switches.

The pig tail or intermediate guides 15 along the length of a ring spinning machine 10 are mounted on a common mounting rod or bar 32 in order to permit a doffer to readily move all of the guides to a raised or withdrawn position during doffing. In accordance with the present invention, suitable means, shown in the form of a flag or flap of magnetic material 34, are fixed to the common mounting bar 32 for movement with the intermediate guides 15. The flap or flag 34 cooperates with a device 35 (which again may be a Hall effect device or some other form of device) and provides a sensor means for generating an electrical signal upon movement of the guides 15 to a predetermined position indicative that the machine is being doffed. That is, when a doffer begins the process of doffing a ring spinning machine and moves the intermediate guides 15 to the withdrawn or raised position (to the phantom line positions in FIG. 6), the flap or flag 34 is withdrawn from the associated device 35 and an electrical signal is generated. While only a single device 35 is shown in FIG. 6, a plurality of sensors may be provided on any ring spinning machine having intermediate guides which are grouped into more than one grouping or area around the machine. Thus, a guide position signal would be generated upon movement of any group of intermediate guides to a position indicative of doffing occurring.

As pointed out hereinabove, the ring rail 20 positions strand material relative to packages during winding. As is known to persons skilled in the applicable textile arts, the ring rail 20 is moved vertically by a portion of the mechanism of a ring spinning machine 10 known as a "builder motion." At the time that doffing is appropriate, or as a first step in the doffing process, the ring rail 20 is moved to a lowered or depressed position substantially clear of the bobbins and wound packages being formed on the spindles 18 in order to provide ready access for the doffer. Such a movement, accomplished by the builder motion either automatically or under the control of a doffer, is known as "bearing down." In accordance with the present invention, a suitable flag or flap 38 is fixed to the ring rail 20 and cooperates with an associated device 39 (similar to the devices 30 and 35 described hereinabove) and provides a sensor means for generating an electrical signal upon movement of the rail 20 to a predetermined position indicative that the machine is ready to be doffed. In the form illustrated, the device 39 which cooperates with the ring rail flag or flap 38 is mounted upon an upright rod 40. The rod 40 may (if desired, but not shown) carry more than one device, in order to respond to movement of the ring rail 20 to other various positions. As is known to persons skilled in the applicable textile arts, certain "builds" of wound packages involve such movement of the ring rail 20 as will bring the rail to a distinctive particular position at some known interval of time in advance of the time for "bearing down" and the beginning of doffing. Where such a builder motion is used, a second device responsive to the position of the ring rail may originate an electrical signal indicative that the machine will be ready to be doffed at a particular time interval in advance of "bearing down."

As briefly pointed out hereinabove, the sensors mounted on each ring spinning machine 10 operatively communicate with processor means responsive to sensor signals for determining from the signals an operating condition of respective ones of the machines and generating a display signal indicative of the determined conditions. As additionally pointed out, the processor means preferably includes, at each spinning machine 10, frame board means 41 (FIG. 6) which is operatively connected with at least one of the sensor means. In the form shown, the frame board means 41 is electrically connected with each of the rotation sensor means 30, guide position sensor means 35, and rail position sensor means 39. The frame board means 41 incorporates appropriate semi-conductor logic circuit means (in forms known to persons skilled in the appropriate arts of data acquisition and processing) for receiving from the sensors electrical signals indicative of the ring rail position, of the intermediate guide position, and of rotation of the front rolls 14. Signals regarding the guide position and ring rail position are, in essence, stored or recorded awaiting inquiry as pointed out more fully hereinafter. Signals indicative of rotation of the delivery rolls 14 are counted, with the numerical count being stored for inquiry as pointed out more fully hereinafter. The frame board includes a universal asynchronous receiver-transmitter (sometimes referred to as a UART) for communication as described more fully hereinafter.

The frame boards 41 of a plurality of the spinning machines 10 communicate with a corresponding one of a plurality of circuit processor means 42 (FIG. 7). Each circuit processor preferably is a micro computer of a commercially available type such as an Intel System 80/10. In a typical textile mill installation having a plurality of ring spinning machines, a plurality of circuit processors 42 are provided, each communicating with a corresponding plurality of frame boards 41 through the use of UARTS. Each circuit processor receives signals not only from the corresponding plurality of frame boards 41 but additionally from portions of the data system carried aboard the traveling units 11, as described more fully in the aforementioned related prior patents incorporated by reference into the present disclosure. The circuit processors receive from the frame boards and traveling units signals indicative of the ring rail positions, guide positions, roll revolution count, ends down, and ends up. From such data, each circuit processor computes delivery rolls speeds in revolutions per minute, time intervals relevant to spinning machine operation as pointed out more fully hereinafter, and totaled ends up and down in order to check for errors in traveling unit operation.

A plurality of circuit processor means 42 communicate with a single main processor 44 (FIG. 7). As with the circuit processors, the main processor preferably is a micro computer of a commercially available type such as Intel System 80/10. The single main processor 44 communicates with the plurality of circuit processors 42 through the use of UARTS. The main processor 44 functions primarily as a master for the entire processor system, with the plurality of circuit processors and the plurality of frame boards responding to the main processor. The main processor receives from the plurality of circuit processors signals indicative of the time intervals relevant to spinning machine operation, delivery roll speeds, ring rail positions, guide positions signals, and ends down. From such data, the main processor computes the acceptability of ends down as pointed out more fully hereinafter and generates display signals in the format necessary to drive the visual display. In the form illustrated, where the visual display is a CRT video device, the main processor generates display signals appropriate for driving such a device. Additionally, the main processor sends to the circuit processors and thence to the appropriate frame boards signals indicative that any annunicator lamps provided at the respective spinning machines should be illuminated.

As will become clear from a thoughtful consideration of the levels of communication and information processing briefly described above, the processor means here described divides the tasks of performing data processing and storing processed information among the frame boards, circuit processors, and main processor. Such an arrangement has been adopted for this invention in the belief that it achieves the mot reasonable balance between efficient data processing and cost effective use of apparatus available at the time of development of the present invention. However, persons skilled in the applicable arts of data processing will be able to appreciate that other arrangements of processors may be employed to achieve essentially the same result, ranging from the use of a single central processing unit for all data processing to a slight redistribution of the processing and storage functions and steps described herein. It is contemplated that the present invention would extend to all such variations in the manner in which data processing apparatus is arranged and employed to achieve the results here described.

Figure 8:
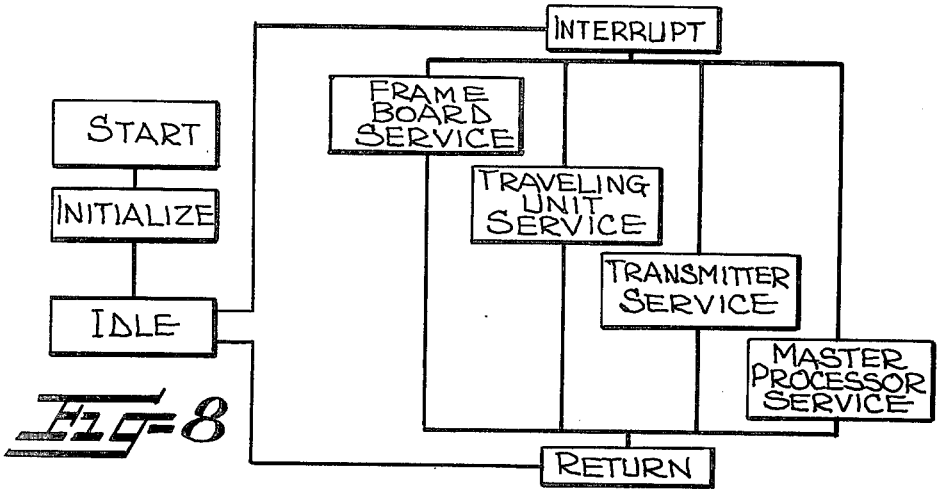
FIG. 8 is a schematic representation of the operation of a circuit processor incorporated in the apparatus according to the present invention.

Referring now more particularly to the operation of the circuit processors, it has been pointed out hereinabove that the circuit processors are used by the master processor essentially as slave devices. All requests originate from the master processor and lead to a particular sequence of operations in the circuit processors and the associated frame boards. Certain circuit processor programs have been diagrammatically represented in FIG. 8. As there suggested, programming (or software) for the circuit processors is a so-called single interrupt type. That is, the circuit processor operates essentially in an idle loop sub-routine, performing low priority tasks and awaiting some interrupt signal. Upon the occurrence of an interrupt signal, the idle loop is interrupted and the programming moves to one of a plurality of parallel sub routines. At this point, all other possibilities of an interrupt are disabled until such time as the sub-routine chosen has been completed and the program cycles back to the idle loop. The sub-routines may include sub-routines known as frame service, transmitter service, master processor service and cleaner service providing for communication of information between the circuit processor and corresponding other elements of the arrangement in accordance with the present invention.

Figure 9:
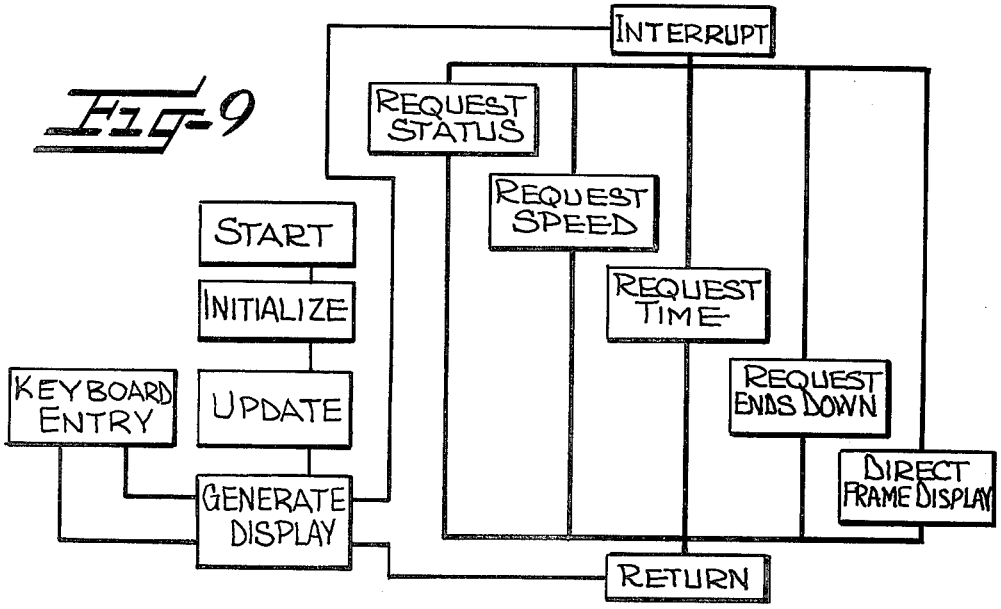
FIG. 9 is a schematic representation similar to FIG. 8 of the operation of a main processor incorporated in the apparatus of the present invention.

Programming for the main processor (as schematically represented in FIG. 9) is such that the master processor operates on two levels. One level is a background level which maintains display signals for the visual display devices. The other level is a foreground level which handles communication with the circuit processors and supplies data for the background level. Both background and foreground programs run in loops and are concurrently running in the sense that they are independent one of the other as to their sequence. In point of view of operations, the background and foreground programs are interleaved one into another with interrupt routines and patches. While the foreground program, in effect, interrupts the background program, both may be interrupted by keyboard commands. In any such instance, specific sequences within the programs do not change, but are merely delayed. The foreground program is, in part, a loop polling the circuit processors in a predetermined sequence in order to communicate to the circuit processors requests originating from keyboard commands. Each foreground interrupt sequence is a series of subroutines, each of which can branch by calling up other sub-routines. In such an arrangement, sub-routines may be nested one within another to substantial depth.

As an example of the manner in which communication may occur, communication between a circuit processor and one specific frame board may entail the interchange of a succession of four words with each word consisting of eleven binary bits. Each word communicated from a circuit processor to a frame board triggers a return word from the frame board to the circuit processor with the particular sequence of words serving to confirm system operation. For example, transmittal of an address word identifying a specific frame board calls for an answering status word including as a portion thereof a numerical representation of the then existing count of roll revolutions together with an indication of any frame signal lights which may be illuminated. The next following transmitted word may be a test word, to be answered by a word including an identification of the frame number. The next transmitted word from the circuit processor to the frame board may be an intentional dummy word, triggering as a response a repetition of the next preceding command word transmitted to that frame board. Thereafter, any new command word indicating the then desired state of the frame signal lights would be transmitted, to be answered by a repetition of the previously transmitted test word, completing a check of the system between the circuit processor and the respective frame board. A similar pattern of communication exists on a continuing polling basis between the foreground programs of the main processor and the circuit processors. The requests from the main processor may include a request for data concerning style and errors from varying frames, errors and roll speeds, command and status words being communicated, frame times, ends down information, and others.

Data thus gathered is employed in a visual display as indicated in FIGS. 1 and 3. Preferably, the visual display takes the form of a cathode ray tube (CRT) video device on which representations of spinning machines 10 located within a textile mill appear as white rectilinear forms. In the event that the distribution of machines within a textile mill room is necessarily somewhat uneven due to the presence of columns, the location of columns may be indicated by letters X (FIG. 3). Numbers within each rectilinear block identify machines by the numbers employed by mill management. In the form shown in FIG. 3, such machine numbers appear as three digit numbers to the left end of the rectilinear blocks representing machines. The machine number is replaced with a letter S (as is visible on one frame in FIG. 3) when the machine has been stopped before completing a calculated running time to doff or after a predetermined period of time has elapsed during doffing and the machine has not been restarted. In either instance, the letter S is accompanied by a number indicating the number of minutes which have elapsed since the machine was stopped. In the event that a request has been entered for the display of delivery roll speed, the machine number is replaced with the letters SP and a numerical indication of revolutions per minute of the delivery rolls. Under normal operating conditions, numbers appearing to the right-hand ends of the rectilinear machine representations indicate the minutes remaining until doffing is due or, if flashing, the minutes which have elapsed since doffing was begun.

Inasmuch as the main processor receives from circuit processors and traveling units information concerning ends down, the main processor has the capability of determining ends down by alleys. That is, the total number of ends down on a pair of facing machine sides may be determined and displayed. Where a machine side faces a wall or the like rather than facing another machine side, the ends down are determined for the one machine side alone. Thus, the number 7 to one side of spinning machine 259 in FIG. 9 indicates 7 ends down or broken yarns along that machine side. However, the number 10 displayed in the alley between machines 205 and 207 indicates a total of 10 ends down or broken yarns on the facing machine sides of those two machines.

As indicated by lines in the lower right portion of the screen, eight machines are currently in doff, thirteen machines will require doffing within the next sixty minutes, and the total number of ends down within the room at the moment is 120.

Two special visual notations are included to indicate overruns and underruns of expected doffing times. Inasmuch as anticipated doffing times are determined primarily from revolutions of the delivery rolls and the known quantities of strand materials normally wound onto packages, it is contemplated that, upon occasion a spinning machine may reach the end of the calculated running time to doff and yet have packages which are not yet entirely full. Under such circumstance, a doffer or spinner attending the machine may determine that the machine should continue to run and the special visual notation OVR will appear on the machine display. Similarly, in the event that a doffer or spinner tending a machine determines that an early doff should occur, a special visual notation UNR appears in order to indicate the underrun. Persons familiar with the programming of micro computers of the types employed in the processor of the present invention will appreciate that other types of warning signals may be originated should they be found desirable or necessary.

In the drawings and specification, there has been set forth a preferred embodiment of the invention, and although specific terms are employed, they are used in a generic and descriptive sense only and not for purposes of limitation.

That which is claimed is:

1. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising:

rotation sensor means mounted on each machine of the group for signalling revolutions of the delivery rolls of the machine, processor means operatively communicating with each of said sensor means of the group of machines and responsive to sensor signals for determining from said signals an operating condition of respective ones of the machines of the group and for generating display signals indicative of the determined conditions of the machines, and visual display means operatively communicating with said processor means and responsive to generated display signals for presenting a visual display of the determined condition of at least a selected one of the group of machines.

2. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising:

guide position sensor means mounted on each machine of the group for signalling the movement of the guides of the machine to a predetermined position, processor means operatively communicating with each of said sensor means of the group of machines and responsive to sensor signals for determining from said signals an operating condition of respective ones of the machines of the group and for generating display signals indicative of the determined conditions of the machines, and visual display means operatively communicating with said processor means and responsive to generated display signals for presenting a visual display of the determined condition of at least a selected one of the group of machines.

3. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising:

rail position sensor means mounted on each machine of the group for signalling the movement of the rails of the machine to a predetermined position, processor means operatively communicating with each of said sensor means of the group of machines and responsive to sensor signals for determining from said signals an operating condition of respective ones of the machines of the group and for generating display signals indicative of the determined conditions of the machines, and visual display means operatively communicating with said processor means and responsive to generated display signals for presenting a visual display of the determined condition of at least a selected one of the group of machines.

4. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising:

rotation sensor means mounted on each machine of the group for signalling revolutions of the delivery rolls of the machine, guide position sensor means mounted on each machine of the group for signalling the movement of the guides of the machine to a predetermined position, processor means operatively communicating with each of said sensor means of the group of machines and responsive to sensor signals for determining from said signals an operating condition of respective ones of the machines of the group and for generating display signals indicative of the determined conditions of the machines, and visual display means operatively communicating with said processor means and responsive to generated display signals for presenting a visual display of the determined condition of at least a selected one of the group of machines.

5. In apparatus for displaying information regarding the operating conditions of a group of ring spinning machines in a textile mill wherein each machine has delivery rolls from which strand material issues and intermediate guides througn which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising:

rotation sensor means mounted on each machine of the group for signalling revolutions of the delivery rolls of the machine, rail position sensor means mounted on each machine of the group for signalling the movement of the rails of the machine to a predetermined position, processor means operatively communicating with each of said sensor means of the group of machines and responsive to sensor signals for determining from said signals an operating condition of respective ones of the machines of the group and for generating display signals indicative of the determined conditions of the machines, and visual display means operatively communicating with said processor means and responsive to generated display signals for presenting a visual display of the determined condition of at least a selected one of the group of machines.

6. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising;

guide position sensor means mounted on each machine of the group for signalling the movement of the guides of the machine to a predetermined position, rail position sensor means mounted on each machine of the group for signalling the movement of the rails of the machine to a predetermined position, processor means operatively communicating with each of said sensor means of the group of machines and responsive to sensor signals for determining from said signals an operating condition of respective ones of the machines of the group and for generating display signals indicative of the determined conditions of the machines, and visual display means operatively communicating with said processor means and responsive to generated display signals for presenting a visual display of the determined condition of at least a selected one of the group of machines.

7. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising:

rotation sensor means mounted on each machine of the group for signalling revolutions of the delivery rolls of the machine, guide position sensor means mounted on each machine of the group for signalling the movement of the guides of the machine to a predetermined position, rail position sensor means mounted on each machine of the group for signalling the movement of the rails of the machine to a predetermined position, processor means operatively communicating with each of said sensor means of the group of machines and responsive to sensor signals for determining from said signals an operating condition of respective ones of the machines of the group and for generating display signals indicative of the determined conditions of the machines, and visual display means operatively communicating with said processor means and responsive to generated display signals for presenting a visual display of the determined condition of at least a selected one of the group of machines.

8. Apparatus according to one of claims 1 through 7 wherein said processor means comprises a plurality of frame board means corresponding in number to the number of the machines, each said frame board means being operatively connected with at least one of said sensor means and responsive to signalling from said sensor means for registering an operating condition of a corresponding one of the machines as indicated by such signalling; and further wherein said processor means comprises a plurality of circuit processor means which number a fraction of the number of said frame board means, each said circuit processor means operatively communicating with a plurality of said frame board means for determining therefrom the registered operating conditions of the corresponding plurality of machines.

9. Apparatus according to one of claims 1 through 7 wherein said processor means comprises a plurality of circuit processor means which number a fraction of the number of the machines, each said circuit processor means operatively communicating with a plurality of said sensor means for determining the operating conditions of the corresponding plurality of the machines; and further wherein said processor means comprises a single main processor means operatively communicating with said plurality of circuit processor means and with said display means, said main processor means being responsive to said circuit processor means determining the operating conditions of the machines for generating said display signal.

10. Apparatus according to one of claims 1 through 7 wherein said processor means comprises a plurality of frame board means corresponding in number to the number of the machines, each said frame board means being operatively connected with at least one of said sensor means and responsive to signalling from said sensor means for registering an operating condition of a corresponding one of the machines as indicated by such signalling; and further wherein said processor means comprises a single main processor means operatively communicating with said plurality of frame board means and with said display means, said main processor means being responsive to said frame board means registering the operating conditions of the machines for generating said display signal.

11. Apparatus according to one of claims 1 through 7 wherein said processor means comprises a plurality of frame board means corresponding in number to the number of the machines, each said frame board means being operatively connected with at least one of said sensor means and responsive to signalling from said sensor means for registering an operating condition of a corresponding one of the machines as indicated by such signalling; and further wherein said processor means comprises a plurality of circuit processors which number a fraction of the number of said frame board means, each said circuit processor means operatively communicating with a plurality of said frame board means for determining therefrom the registered operating conditions of the corresponding plurality of machines; and further wherein said processor means comprises a single main processor means operatively communicating with said plurality of circuit processor means and with said display means, said main processor means being responsive to said circuit processor means determining the operating conditions of the machines for generating said display signal.

12. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising:

rotation sensor means mounted on each machine of the group for generayting a train of electrical pulse signals at a frequency proportional to revolutions of the delivery rolls of the machine, processor means operatively communicating with each of said sensor means of the group of machines and responsive to sensor signals for determining from said signals the operating time remaining before doffing of respective ones of the machines of the group and for generating display signals indicative of the determined time conditions, and visual display means operatively communicating with said processor means and responsive to generated display signals for presenting a numerical visual display of the determined time condition of at least a selected one of the group of machines.

13. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising:

rotation sensor means mounted on each machine of the group for generating a train of electrical pulse signals at a frequency proportional to revolutions of the delivery rolls of the machine, processor means operatively communicating with each of said sensor means of the group of machines and responsive to sensor signals for determining from said signals the roll speed in revolutions per minute of respective ones of the machines of the group and for generating display signals indicative of the determined speed conditions, and visual display means operatively communicating with said processor means and responsive to generated display signals for presenting a numerical visual display of the determined speed condition of at least a selected one of the group of machines.

14. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising:

rotation sensor means mounted on each machine of the group for generating a train of electrical pulse signals at a frequency proportional to revolutions of the delivery rolls of the machine, processor means operatively communicating with each of said sensor means of the group of machines and responsive to sensor signals for determining from said signals the operating time remaining before doffing and the roll speed in revolutions per minute of respective ones of the machines of the group and for generating display signals indicative of the determined time and speed conditions, and visual display means operatively communicating with said processor means and responsive to generated display signals for presenting a numerical visual display of at least one selected one of the determined time and speed conditions of at least a selected one of the group of machines.

15. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising:

guide position sensor means mounted on each machine of the group for generating an electrical signal upon movement of the guides of the machine to a predetermined position indicative that the machine is being doffed, processor means operatively communicating with each of said sensor means of the group of machines and responsive to sensor signals for determining from said signals that doffing is in progress at respective ones of the machines of the group and for generating display signals indicative of the determined doffing conditions, and visual display means operatively communicating with said processor means and responsive to generated display signals for presenting a visual display of the determined doffing condition of at least a selected one of the group of machines.

16. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising:

guide position sensor means mounted on each machine of the group for generating an electrical signal upon movement of the guides of the machine to a predetermined position indicative that the machine is being doffed, processor means operatively communicating with each of said sensor means of the group of machines and responsive to sensor signals for determining from said signals the interval of time required for doffing of respective ones of the machines of the group and for generating display signals indicative of the determined time conditions, and visual display means operatively communicating with said processor means and responsive to generated display signals for presenting a numerical visual display of the determined time condition of at least a selected one of the group of machines.

17. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising:

guide position sensor means mounted on each machine of the group for generating an electrical signal upon movement of the guides of the machine to a predetermined position indicative that the machine is being doffed, processor means operatively communicating with each of said sensor means of the group of machines and responsive to sensor signals for determining from said signals that doffing is in progress at respective ones of the machines of the group and the interval of time required for doffing of the machine and for generating display signals indicative of the determined doffing and time conditions, and visual display means operatively communicating with said processor means and responsive to generated display signals for presenting a visual display of at least one selected one of the determined doffing and time conditions of at least a selected one of the group of machines.

18. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, and wherein the apparatus has at least one traveling unit supported for travel along a predetermined path for traversing one or more of the machines, detectors mounted on the traveling unit for monitoring ends of strand material normally being formed by a traversed machine, and a data system responsive to the detectors for determining the ends down condition of the traversed machine from the conditions of the monitored ends, an improvement comprising:

rail position sensor means mounted on each machine of the group for generating an electrical signal upon movement of the rails of the machine to a predetermined position indicative that the machine is ready to be doffed, processor means operatively communicating with each of said sensor means of the group of machines and responsive to sensor signals for determining from said signals the readiness for doffing of respective ones of the machines of the group and for generating display signals indicative of the determined doffing readiness conditions, and visual display means operatively communicating with said processor means and responsive to generated display signals for presenting a visual display of the determined readiness condition of at least a selected one of the group of machines.

19. Apparatus according to one of claims 12 through 18 wherein said visual display means comprises a cathode ray tube video display device operatively communicating with said processor means and driven thereby for presenting a representation of the machines and the determined conditions thereof.

20. Apparatus according to one of claims 14 and 17 further comprising keyboard means operatively communicating with said processor means for selecting one of the determined conditions to be displayed.

21. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, an improvement comprising:

rotation sensor means mounted on each machine of the group for generating a train of electrical pulse signals at a frequency proportional to revolutions of the delivery rolls of the machine, processor means operatively communicating with each of said sensor means of the group of machines and responsive to sensor signals for determining from said signals the operating time remaining before doffing of respective ones of the machines of the group and for generating display signals indicative of the determined time conditions of the machines, and cathode ray tube video display means operatively communicating with said processor means and responsive to generated display signals for presenting a numerical visual display of the determined time conditions of at least a selected one of the group of machines.

22. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, an improvement comprising:

rotation sensor means mounted on each machine of the group for generating a train of electrical pulse signals at a frequency proportional to revolutions of the delivery rolls of the machine, processor means operatively communicating with each of said sensor means of the group of machines and responsive to sensor signals for determining from said signals the delivery roll speed in revolutions per minute of respective ones of the machines of the group and for generating display signals indicative of the determined speed conditions of the machines, and cathode ray tube video display means operatively communicating with said processor means and responsive to generated display signals for presenting a numerical visual display of the determined speed condition of at least a selected one of the group of machines.

23. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, an improvement comprising:

rotation sensor means mounted on each machine of the group for generating a train of electrical pulse signals at a frequency proportional to revolutions of the delivery rolls of the machine, processor means operatively communicating with each of said sensor means of the group of machines and responsive to sensor signals for determining from said signals the operating time remaining before doffing and the delivery roll speed in revolutions per minute of respective ones of the machines of the group and for generating display signals indicative of the determined time and speed conditions of the machines, and cathode ray tube video display means operatively communicating with said processor means and responsive to generated display signals for presenting a numerical visual display of at least one selected one of the determined time and speed conditions of at least a selected one of the group of machines.

24. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, an improvement comprising:

guiding position sensor means mounted on each machine of the group for generating an electrical signal upon movement of the guides of the machine to a predetermined position indicative that the machine is being doffed, processor means operatively communicating with each of said sensor means of the group of machines and responsive to sensor signals for determining from said signals that doffing is in progress at respective ones of the machines of the group and for generating display signals indicative of the determined doffing conditions of the machines, and cathode ray tube video display means operatively communicating with said processor means and responsive to generated display signals for presenting a visual display of the determined doffing conditions of at least a selected one of the group of machines.

25. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, an improvement comprising:

guide position sensor means mounted on each machine of the group for generating an electrical signal upon movement of the guides of the machine to a predetermined position indicative that the machine is being doffed, processor means operatively communicating with each of said sensor means of the group of machines and responsive to sensor signals for determining from said signals the interval of time required for doffing of respective ones of the machines of the group and for generating display signals indicative of the determined time conditions of the machines, and cathode ray tube video display means operatively communicating with said processor means and responsive to generated display signals for presenting a numerical visual display of the determined time conditions of at least a selected one of the group of machines.

26. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, an improvement comprising:

guide position sensor means mounted on each machine of the group for generating an electrical signal upon movement of the guides of the machine to a predetermined position indicative that the machine is being doffed, processor means operatively communicating with each of said sensor means of the group of machines and responsive to sensor signals for determining from said signals that doffing is in progress at respective ones of the machines of the group and the interval of time required for doffing and for generating display signals indicative of the determined doffing and time conditions of the machines, and cathode ray tube video display means operatively communicating with said processor means and responsive to generated display signals for presenting a visual display of at least one selected one of the determined doffing and time conditions of at least a selected one of the group of machines.

27. In apparatus for displaying information regarding the operating conditions of a group of ring spinning machines in a textile mill wherein each machine has delivery rolls from which strand material issues and intermediate guides through which strand material passes and ring rails by which strand material is formed into packages during winding thereof, an improvement comprising:

rail position sensor means mounted on each machine of the group for generating an electrical signal upon movement of the rails of the machine to a predetermined position indicative that the machine is ready to be doffed, processor means operatively communicating with each of said sensor means of the group of machines and responsive to sensor signals for determining from said signals the readiness for doffing of respective ones of the machines of the group and for generating display signals indicative of the determined doffing readiness conditions of the machines, and cathode ray tube video display means operatively communicating with said processor means and responsive to generated display signals for presenting a visual display of the determined readiness conditions of at least a selected one of the group of machines.

28. Apparatus according to one of claims 21 through 27 wherein said processor means comprises a plurality of frame board means corresponding in number to the number of the machines, each said frame board means being operatively connected with at least one of said sensor means and responsive to signalling from said sensor means for registering an operating condition of a corresponding one of the machines as indicated by such signalling; and further wherein said processor means comprises a plurality of circuit processor means which number a fraction of the number of said frame board means, each said circuit processor means operatively communicating with a plurality of said frame board means for determining therefrom the registered operating conditions of the corresponding plurality of machines.

29. Apparatus according to one of claims 21 through 27 wherein said processor means comprises a plurality of circuit processor means which number a fraction of the number of the machines, each said circuit processor means operatively communicating with a plurality of said sensor means for determining the operating conditions of the corresponding plurality of the machines; and further wherein said processor means comprises a single main processor means operatively communicating with said plurality of circuit processor means and with said display means, said main processor means being responsive to said circuit processor means determining the operating conditions of the machines for generating said display signal.

30. Apparatus according to one of claims 21 through 27 wherein said processor means comprises a plurality of frame board means corresponding in number to the number of the machines, each said frame board means being operatively connected with at least one of said sensor means and responsive to signalling from said sensor means for registering an operating condition of a corresponding one of the machines as indicated by such signalling; and further wherein said processor means comprises a single main processor means operatively communicating with said plurality of frame board means and with said display means, said main processor means being responsive to said frame board means registering the operating conditions of the machines for generating said display signal.

31. Apparatus according to one of claims 21 through 27 wherein said processor means comprises a plurality of frame board means corresponding in number to the number of the machines, each said frame board means being operatively connected with at least one of said sensor means and responsive to signalling from said sensor means for registering an operating condition of a corresponding one of the machines as indicated by such signalling; and further wherein said processor means comprises a plurality of circuit processors which number a fraction of the number of said frame board means, each said circuit processor means operatively communicating with a plurality of said frame board means for determining therefrom the registered operating conditions of the corresponding plurality of machines; and further wherein said processor means comprises a single main processor means operatively communicating with said plurality of circuit processor means and with said display means, said main processor means being responsive to said circuit processor means determining the operating conditions of the machines for generating said display signal.

32. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group rotary movement of the delivery rolls of that machine and signalling such sensed movement, determining from signalled, sensed movement an operating condition of respective ones of the machines of the group and generating display signals indicative of the determined conditions of the machines, and visually displaying in response to the generated display signals indicia representative of the determined conditions of at least a selected one of the group of machines.

33. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group movement of the guides of the machine to a predetermined position and signalling such sensed movement, determining from signalled, sensed movement an operating condition of respective ones of the machines of the group and generating display signals indicative of the determined conditions of the machines, and visually displaying in response to the generated display signals indicia representative of the determined conditions of at least a selected one of the group of machines.

34. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group movement of the rails of the machine to a predetermined position and signalling such sensed movement, determining from signalled, sensed movement an operating condition of respective ones of the machines of the group and generating display signals indicative of the determined conditions of the machines, and visually displaying in response to the generated display signals indicia representative of the determined conditions of at least a selected one of the group of machines.

35. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group rotary movement of the delivery rolls of that machine and signalling such sensed movement, sensing at each machine of the group movement of the guides of the machine to a predetermined position and signalling such sensed movement, determining from signalled, sensed movement an operating condition of respective ones of the machines of the group and generating display signals indicative of the determined conditions of the machines, and visually displaying in response to the generated display signals indicia representative of the determined conditions of at least a selected one of the group of machines.

36. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group rotary movement of the delivery rolls of that machine and signalling such sensed movement, sensing at each machine of the group movement of the rails of the machine to a predetermined position and signalling such sensed movement, determining from signalled, sensed movement an operating condition of respective ones of the machines of the group and generating display signals indicative of the determined conditions of the machines, and visually displaying in response to the generated display signals indicia representative of the determined conditions of at least a selected one of the group of machines.

37. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group movement of the guides of the machine to a predetermined position and signalling such sensed movement, sensing at each machine of the group movement of the rails of the machine to a predetermined position and signalling such sensed movement, determining from signalled, sensed movement an operating condition of respective ones of the machines of the group and generating display signals indicative of the determined conditions of the machines, and visually displaying in response to the generated display signals indicia representative of the determined conditions of at lease a selected one of the group of machines.

38. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group rotary movement of the delivery rolls of that machine and signalling such sensed movement, sensing at each machine of the group movement of the guides of the machine to a predetermined position and signalling such sensed movement, sensing at each machine of the group movement of the rails of the machine to a predetermined position and signalling such sensed movement, determining from signalled, sensed movements an operating condition of respective ones of the machines of the group and generating display signals indicative of the determined conditions of the machines, and visually displaying in response to the generated display signals indicia representative of the determined conditions of at least a selected one of the group of machines.

39. A method according to one of claims 32 through 38 wherein the steps of determining an operating condition and generating display signals comprise communicating signals indicative of sensed movement at a machine to a corresponding one of a plurality of frame boards corresponding in number to the number of the machines and registering the sensed movement signals at the frame board and further wherein the steps comprise communicating registered signals from a plurality of frame boards to a corresponding one of a plurality of circuit processors and determining from the communicated signals at the circuit processor the operating conditions of the machines.

40. A method according to one of claims 32 through 38 wherein the steps of determining an operating condition and generating display signals comprise communicating signals indicative of sensed movement from a plurality of machines to a corresponding one of a plurality of circuit processors which number a fraction of the number of the machines and determining from the communicated signals at the circuit processor the operating conditions of the machines, and further wherein the steps comprise communicating the determined operating conditions from a plurality of circuit processors to a single main processor and generating from the communicated signals at the main processor the display signals.

41. A method according to one of claims 32 through 38 wherein the steps of determining an operating condition and generating display signals comprise communicating signals indicative of sensed movement at a machine to a corresponding one of a plurality of frame boards corresponding in number to the number of machines and registering the sensed movement signals at the frame board, and further wherein the steps comprise communicating signals from a plurality of frame boards to a single main processor and generating from the communicated signals at the main processor the display signals.

42. A method according to one of claims 32 through 38 wherein the steps of determining an operating condition and generating display signals comprise communicating signals indicative of sensed movement at a machine to a corresponding one of a plurality of frame boards corresponding in number to the number of the machines and registering the sensed movement signals at the frame board and further wherein the steps comprise communicating registered signals from a plurality of frame boards to a corresponding one of a plurality of circuit processors and determining from the communicated signals at the circuit processor the operating conditions of the machines, and further wherein the steps comprise communicating the determined operating conditions from a plurality of circuit processors to a single main processor and generating from the communicated signals at the main processor the display signals.

43. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group rotary movement of the delivery rolls of that machine and generating a train of electrical pulse signals having a frequency proportional to such sensed movement, determining from signalled, sensed movement the rotational speed of the delivery rolls of respective ones of the machines of the group and generating display signals indicative of the determined speed conditions of the machines, and visually displaying in response to the generated display signals numerical indicia representative of the determined conditions of at least a selected one of the group of machines.

44. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group rotary movement of the delivery rolls of that machine and generating a train of electrical pulse signals having a frequency proportional to such sensed movement, determining from signalled, sensed movement the time interval remaining before doffing of respective ones of the machines of the group and generating display signals indicative of the determined time conditions of the machines, and visually displaying in response to the generated display signals numerical indicia representative of the determined time conditions of at least a selected one of the group of machines.

45. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group rotary movement of the delivery rolls of that machine and generating a train of electrical pulse signals having a frequency proportional to such sensed movement, determining from signalled, sensed movement the rotational speed of the delivery rolls of respective ones of the machines of the group and the time interval remaining before doffing and generating display signals indicative of the determined speed and time conditions of the machines, and visually displaying in response to the generated display signals indicia representative of at least one selected one of the determined conditions of at least a selected one of the group of machines.

46. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group movement of the guides of the machine to a predetermined position indicative of doffing of the machine and generating an electrical signal in response to such sensed movement, determining from signalled, sensed movement the occurrence of doffing of respective ones of the machines of the group and generating display signals indicative of the determined doffing condition of the machines, and visually displaying in response to generated display signals indicia representative of the determined conditions of at least a selected one of the group of machines.

47. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group movement of the guides of the machine to a predetermined position indicative of doffing of the machine and generating an electrical signal in response to such sensed movement, determining from signalled, sensed movement the time interval during which doffing of respective ones of the machines of the group occurs and generating display signals indicative of the determined time conditions of the machines, and visually displaying in response to generated display signals numerical indicia representative of the determined conditions of at least a selected one of the group of machines.

48. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group movement of the guides of the machine to a predetermined position indicative of doffing of the machine and generating an electrical signal in response to such sensed movement, determining from signalled, sensed movement the occurrence of doffing of respective ones of the machines of the group and the time interval during which doffing occurs and generating display signals indicative of the determined conditions of the display signals indicative of the determined conditions of the machines, and visually displaying in response to generated display signals indicia representative of at least one selected one of the determined conditions of at least a selected one of the group of machines.

49. In a method of displaying information regarding the operating conditions of a group of ring spinning machines in a textile mill wherein strand material issues from delivery rolls and passes through intermediate guides and is formed into packages by ring rails during winding, and wherein the method includes traversing one or more machines with a traveling unit having a detector moving therewith while monitoring ends of strand material normally being formed by a traversed machine, and responding to the monitoring of ends by determining the ends down condition of the traversed machine, an improvement comprising:

sensing at each machine of the group movement of the rails of the machine to a predetermined position and generating an electrical signal in response to such sensed movement and indicative that the machine is ready to be doffed, determining from signalled, sensed movement the readiness for doffing of respective ones of the machines of the group and generating display signals indicative of the determined doffing readiness conditions of the machines, and visually displaying in response to generated display signals indicia representative of the determined conditions of at least a selected one of the group of machines.

50. In a method of displaying information regarding the operating conditions of a group of ring spinning machines in a textile mill wherein strand material issues from delivery rolls and passes through intermediate guides and is formed into packages by ring rails during winding, an improvement comprising:

sensing at each machine of the group rotary movement of the delivery rolls of that machine and generating a train of electrical pulse signals having a frequency proportional to such sensed movement, determining from signalled, sensed movement the rotational speed of the delivery rolls of respective ones of the machines of the group and generating display signals indicative of the determined speed conditions of the machines, and displaying on a cathode ray tube video device and in response to the generated display signals numerical indicia representative of the determined conditions of at least a selected one of the group of machines.

51. In a method of displaying information regarding the operating conditions of a group of ring spinning machines in a textile mill wherein strand material issues from delivery rolls and passes through intermediate guides and is formed into packages by ring rails during winding, an improvement comprising:

sensing at each machine of the group rotary movement of the delivery rolls of that machine and generating a train of electrical pulse signals having a frequency proportional to such sensed movement, determining from signalled, sensed movement the time interval remaining before doffing of respective ones of the machines of the group and generating display signals indicative of the determined time conditions of the machines, and displaying on a cathode ray tube video device and in response to the generated display signals numerical indicia representative of the determined time conditions of at least a selected one of the group of machines.

52. In a method of displaying information regarding the operating conditions of a group of ring spinning machines in a textile mill wherein strand material issues from delivery rolls and passes through intermediate guides and is formed into packages by ring rails during winding, an improvement comprising:

sensing at each machine of the group rotary movement of the delivery rolls of that machine and generating a train of electrical pulse signals having a frequency proportional to such sensed movement, determining from signalled, sensed movement the rotational speed of the delivery rolls of respective ones of the machines of the group and the time interval remaining before doffing and generating display signals indicative of the determined speed and time conditions of the machines, and displaying on a cathode ray tube video device and in response to the generated display signals indicia representative of at least one selected one of the determined conditions of at least a selected one of the group of machines.

53. In a method of displaying information regarding the operating conditions of a group of ring spinning machines in a textile mill wherein strand material issues from delivery rolls and passes through intermediate guides and is formed into packages by ring rails during winding, an improvement comprising:

sensing at each machine of the group movement of the guides of the machine to a predetermined position indicative of doffing of the machine and generating an electrical signal in response to such sensed movement, determining from signalled, sensed movement the occurrence of doffing of respective ones of the machines of the group and generating display signals indicative of the determined doffing conditions of the machines, and displaying on a cathode ray tube video device and in response to the generated display signals indicia representative of the determined conditions of at least a selected one of the group of machines.

54. In a method of displaying information regarding the operating conditions of a group of ring spinning machines in a textile mill wherein strand material issues from delivery rolls and passes through intermediate guides and is formed into packages by ring rails during winding, an improvement comprising:

sensing at each machine of the group movement of the guides of the machine to a predetermined position indicative of doffing of the machine and generating an electrical signal in response to such sensed movement, determining from signalled, sensed movement the time interval during which doffing of respective ones of the machines of the group occurs and generating display signals indicative of the determined time conditions of the machines, and displaying on a cathode ray tube video device and in response to the generated display signals numerical indicia representative of the determined conditions of at least a selected one of the group of machines.

55. In a method of displaying information regarding the operating conditions of a group of ring spinning machines in a textile mill wherein strand material issues from delivery rolls and passes through intermediate guides and is formed into packages by ring rails during winding, an improvement comprising:

sensing at each machine of the group movement of the guides of the machine to a predetermined position indicative of doffing of the machine and generating an electrical signal in response to such sensed movement, determining from signalled, sensed movement the occurrence of doffing and respective ones of the machines of the group and the time interval during which doffing occurs and generating display signals indicative of the determined conditions of the machines, and displaying on a cathode ray tube video device and in response to the generated display signals indicia representative of at least one selected one of the determined conditions of at least a selected one of the group of machines.

56. In a method of displaying information regarding the operating conditions of a group of ring spinning machines in a textile mill wherein strand material issues from delivery rolls and passes through intermediate guides and is formed into packages by ring rails during winding, an improvement comprising:

sensing at each machine of the group movement of the rails of the machine to a predetermined position and generating an electrical signal in response to such sensed movement and indicative that the machine is ready to be doffed, determining from signalled, sensed movement the readiness for doffing of respective ones of the machines of the group and generating display signals indicative of the determined doffing readiness conditions of the machines, and displaying on a cathode ray tube video device and in response to the generated display signals indicia representative of the determined conditions of at least a selected one of the group of machines.

57. A method according to one of claims 50 through 56 wherein the steps of determining an operating condition and generating display signals comprise communicating signals indicative of sensed movement at a machine to a corresponding one of a plurality of frame boards corresponding in number to the number of the machines and registering the sensed movement signals at the frame board and further wherein the steps comprise communicating registered signals from a plurality of frame boards to a corresponding one of a plurality of circuit processors and determining from the communicated signals at the circuit processor the operating conditions of the machines.

58. A method according to one of claims 50 through 56 wherein the steps of determining an operating condition and generating display signals comprise communicating signals indicative of sensed movement from a plurality of machines to a corresponding one of a plurality of circuit processors which number a fraction of the number of the machines and determining from the communicated signals at the circuit processor the operating conditions of the machines, and further wherein the steps comprise communicating the determined operating conditions from a plurality of circuit processors to a single main processor and generating from the communicated signals at the main processor the display signals.

59. A method according to one of claims 50 through 56 wherein the steps of determining an operating condition and generating display signals comprise communicating signals indicative of sensed movement at a machine to a corresponding one of a plurality of frame boards corresponding in number to the number of machines and registering the sensed movement signals at the frame board, and further wherein the steps comprise communicating signals from a plurality of frame boards to a single main processor and generating from the communicated signals at the main processor the display signals.

60. A method according to one of claims 50 through 56 wherein the steps of determining an operating condition and generating display signals comprise communicating signals indicative of sensed movement at a machine to a corresponding one of a plurality of frame boards corresponding one of a plurality of frame boards corresponding in number to the number of the machines and registering the sensed movement signals at the frame board and further wherein the steps comprise communicating registered signals from a plurality of frame boards to a corresponding one of a plurality of circuit processors and determining from the communicated signals at the circuit processor the operating conditions of the machines, and further wherein the steps comprise communicating the determined operating conditions from a plurality of circuit processors to a single main processor and generating from the communicated signals at the main processor the display signals.

* * * * *

UNITED STATES PATENT AND TRADEMARK OFFICE

CERTIFICATE OF CORRECTION

PATENT NO. : 4,194,349

DATED : Mar. 25, 1980

INVENTOR(S) : John E. Lane

It is certified that error appears in the above-identified patent and that said Letters Patent are hereby corrected as shown below:

Column 6, Line 33, "annunicator" should be - annunciator -.

Column 6, Line 42, "mot" should be - most -.

Column 8, Line 42, "FIG. 9" should be -FIG. 3 -.

Column 13, Line 61, "generayting" should be - generating -.

Column 18, Line 37, "guding" should be - guide -.

Column 23, Line 16, "lease" should be - least -.

Column 26, Lines 49 and 50, "display signals indicative of the determined conditions of the" should be omitted.

Column 30, Lines 25 and 26, "one of a plurality of frame boards corresponding" should be omitted.

Signed and Sealed this

*Fifth* Day of *August 1980*

[SEAL]

*Attest:*

SIDNEY A. DIAMOND

*Attesting Officer*

*Commissioner of Patents and Trademarks*